United States Patent [19]

Alford et al.

[11] 4,207,854

[45] Jun. 17, 1980

[54] INLET AIR PASSAGE FOR AN ENGINE

[75] Inventors: Richard R. Alford, Peoria; Alan R. Stockner, Chillicothe, both of Ill.

[73] Assignee: Caterpillar Tractor Co., Peoria, Ill.

[21] Appl. No.: 869,195

[22] Filed: Jan. 13, 1978

[51] Int. Cl.[2] ..... F01L 3/00; F02B 3/00

[52] U.S. Cl. ..... 123/188 M; 123/30 C

[58] Field of Search ..... 123/188 M, 30 C, 188 S, 123/141, 52 M

[56] References Cited

U.S. PATENT DOCUMENTS

| | | | |
|---|---|---|---|
| 2,920,613 | 1/1960 | Vogel et al. | 123/188 M |
| 3,035,558 | 5/1962 | Wiebicke et al. | 123/188 M |
| 3,335,707 | 8/1967 | Heinrich | 123/188 M |
| 4,015,577 | 4/1977 | Elsbett et al. | 123/188 M |

*Primary Examiner*—Ira S. Lazarus
*Assistant Examiner*—Magdalen Moy
*Attorney, Agent, or Firm*—Phillips, Moore, Weissenberger, Lempio & Majestic

[57] ABSTRACT

A concave surface forms a section of the inner wall of an inlet air passage in the cylinder head of an internal combustion engine with the concave surface facing towards the outer wall of the passage. The inlet passage leads to a valve past which air is introduced into a cylinder of the engine.

4 Claims, 7 Drawing Figures

INLET AIR PASSAGE FOR AN ENGINE

BACKGROUND OF THE INVENTION

1. Field of the Invention

The invention relates to a particular wall configuration for an inlet air passage for introducing air into an internal combustion engine, primarily of the direct injection diesel type. The particular wall configuration forming the passage of the present invention provides a large amount of swirl, excellent flow coefficient and, in some instances, means for controlling the amount of swirl to optimize engine performance under various operating conditions.

2. Prior Art

It is known to provide vanes or swirlers within the inlet air passage of internal combustion engines to create swirl in the air which passes through the valves of such engines. In one such prior art inlet air system the passage walls create the major swirl while a vane serves to oppose the swirl and introduces a portion of the air passing through the valve pack into the cylinder bore in an opposite direction to the majority of the air passing through the valve into the cylinder bore. This creates turbulence but is, of course, wasteful of energy since air must first be introduced in one direction and then a portion of it must be stopped and redirected in the opposite direction. It is inevitable that a certain amount of reduction in the flow coefficient of such an air system results. Inlet passages have been designed of this nature which utilize both stationary and adjustable vanes or spoilers.

Another prior art design utilizes a rotatable vane which nests against the upper wall of the inlet passage when the engine is running at normal speed and thus does not contribute to swirl of the air in that condition. When the engine is started up and when a cold engine is idled the vane is rotated down from the upper wall of the passage and used to reduce or eliminate swirl whereby the vane in this design also acts as a spoiler as far as air flow is concerned.

Adjustment of flow without reduction thereof or increases in fuel consumption would be very desirable. Yet, the prior art has provided neither of these results.

SUMMARY OF THE INVENTION

The present invention is directed to overcoming one or more of the problems as set forth above.

According to the present invention an improvement is provided in a cylinder assembly of an internal combustion engine which comprises a cylindrical bore, a generally circular valve communicating with an end of said cylindrical bore intermediate an axis and an outer bore wall thereof, said valve being adjacent and substantially tangent to said outer bore wall, said valve having a valve stem extending away from said end of said cylindrical bore and an inlet passage having a first portion extending away from said valve generally parallel to said valve stem and a second portion generally perpendicular to said first portion and extending away from said cylindrical bore, said inlet passage having an outer generally linearly extending wall generally tangent to said outer bore wall adjacent said valve and an inner wall opposite said outer wall. The improvement of the present invention comprises a concave surface forming a section of said inner wall adjacent said valve and facing towards said outer wall. The concave surface falls substantially on a surface of a cylinder which has an axis parallel to that of the cylindrical bore. The radius of curvature of the concave surface is from about 65% to about 35% of the diameter of the cylindrical bore. The section comprises a vane extending from a first end thereof adjacent the valve to a second end thereof spaced from the valve and adjacent a continuation of the inner wall. Means are provided for pivotally attaching a second end of the vane to the inner wall. Means are also provided for rotating the vane about the pivotal attaching means in response to engine speed. The vane is rotated towards the outer wall at lower engine speeds and away from the outer wall at higher engine speeds.

In another sense the invention comprises an improvement in a cylinder assembly as set out above wherein said improvement comprises a recess in the inner wall starting adjacent to the inner wall and proceeding a distance away therefrom; a vane extending from a first end thereof adjacent to said valve to a second end thereof spaced from said valve, said vane being adjacent to said inner wall and generally within said recess; and means for pivotally attaching said second end of said vane to said recess.

BRIEF DESCRIPTION OF THE DRAWINGS

The invention will be better understood by reference to the figures of the drawings wherein like numbers denote like parts throughout and wherein.

DETAILED DESCRIPTION OF THE PREFERRED EMBODIMENTS

Figure 1:
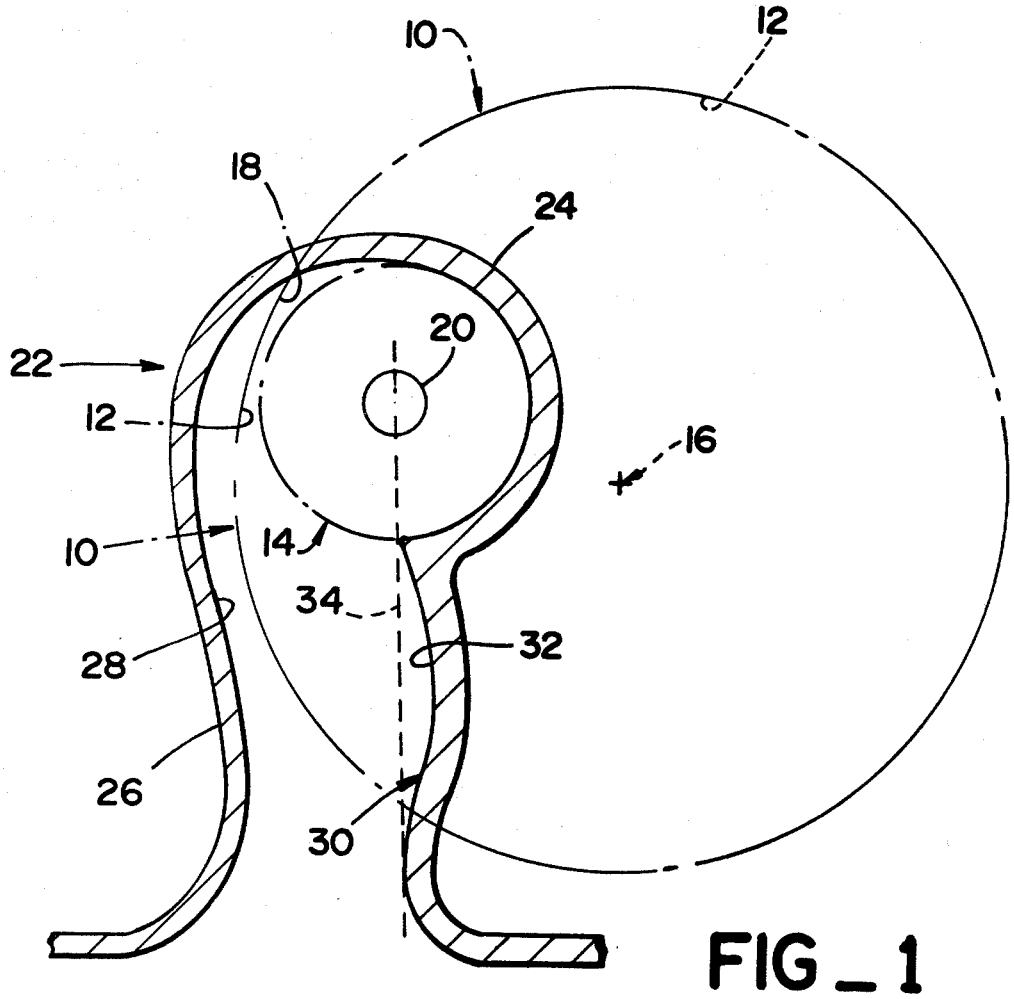
FIG. 1 illustrates in plan view an inlet passage in accordance with the present invention.
Figure 2:
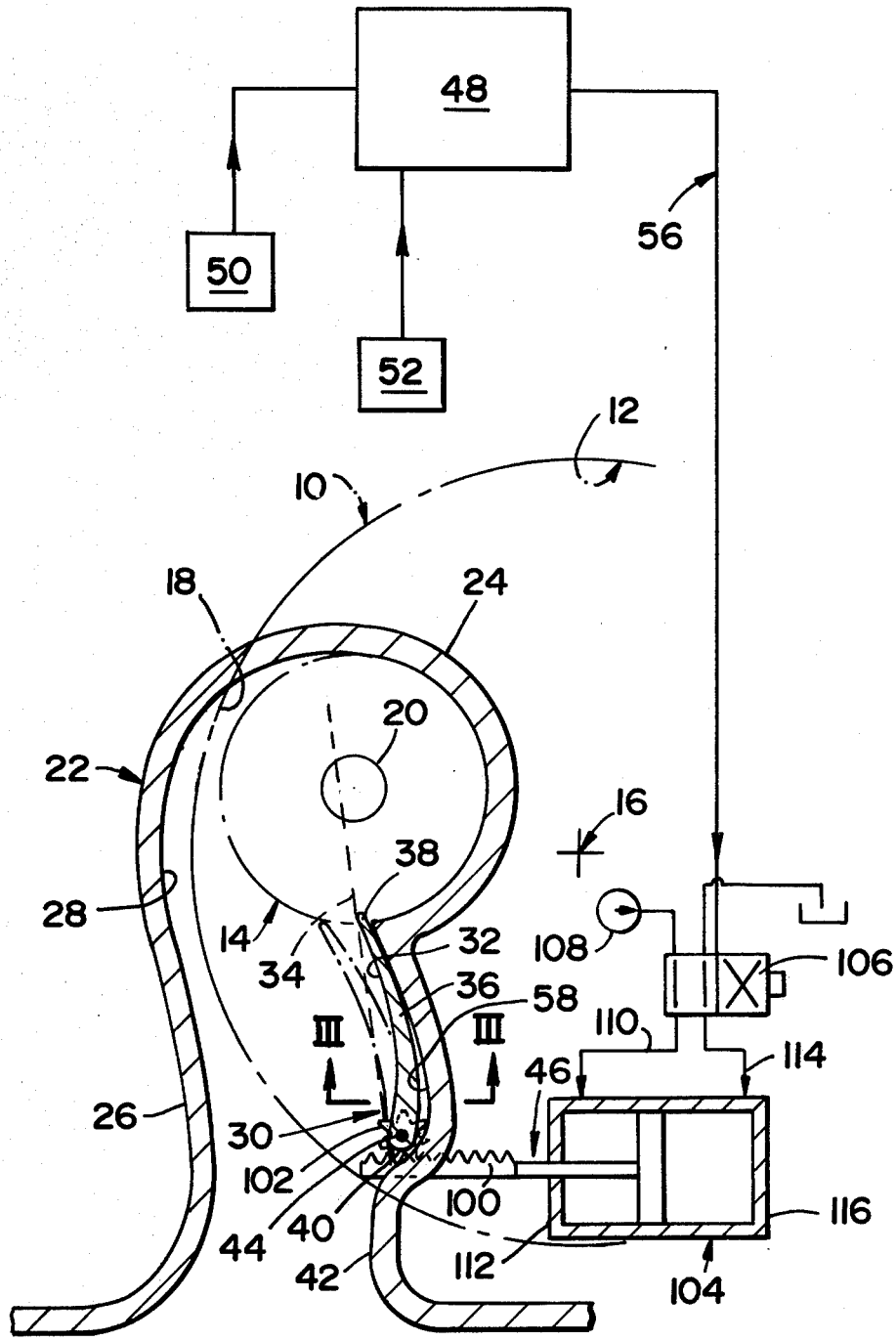
FIG. 2 illustrates in plan view another inlet passage in accordance with the present invention, said inlet passage including an adjustable vane therein.

Adverting to FIG. 1 there is illustrated therein a cylinder assembly 10, shown in phantom, of an internal combustion engine. The cylinder assembly comprises a cylindrical bore 12. A generally circular valve 14 is provided which communicates with one end of the cylindrical bore 12. The valve 14 communicates with the end of the cylindrical bore 12 intermediate an axis 16 of the cylindrical bore 12 and an outer bore wall 18 of the cylindrical bore 12. The valve 14 is located adjacent and substantially tangent to the outer bore wall 18 as illustrated in FIGS. 1 and 2. The valve 14 includes a stem 20 which extends away from the end of the cylindrical bore 12 and may be parallel to the axis 16. An inlet passage 22 is provided which has a first portion 24 which extends away from the valve 14 generally parallel to the valve stem 20 and a second portion 26 which is generally perpendicular to the first portion 24 and which extends away from the cylindrical bore 12. The inlet passage 22 has an outer wall 28 which extends generally linearly and generally tangent to the outer bore wall 18 adjacent the valve 14. The inlet passage 22 further has an inner wall 30 opposite the outer passage wall 28.

In the embodiment illustrated in FIG. 1 the improvement of the present invention comprises a concave surface 32 which forms a section of the inner wall 30 adjacent the valve 14 with the concave surface 32 facing towards the outer wall 28. It is preferred in the embodiments of FIGS. 1–3 that the concave surface 32 corresponds substantially to a surface of a cylinder which has an axis parallel to that of the axis 16 of the cylindrical bore 12 and has a radius of curvature which falls within a range from about 65% to about 35% of the diameter of the cylindrical bore 12. Also in accordance with the present invention, it is very desirable that a chord 34 drawn across the aforementioned concave surface 32 aims substantially at the valve stem 20 so that a distance from a center of the valve stem 20 to a nearest extension of the chord 34 is no more than about 10% of the length of a diameter of the cylindrical bore 12. If one refers to FIG. 1, it will be noted that the chord 34 is drawn across the concave surface 32. An extension of the chord 34 is shown extending through the precise center of the valve stem 20. Thus, the distance between a center of the valve stem 20 and the nearest extension of the chord 34 is zero distance in the particular embodiment illustrated in FIG. 1. However, it is not necessary that this nearest extension from the center of the valve stem 20 to the chord 34 be restricted to be zero distance. It is, however, important that the distance from the center of the valve stem 20 to the nearest point on the extension of the chord 34 be no more than about 10% of the diameter of the cylinder bore 12. If one now refers to FIG. 2, there will be seen an embodiment wherein the extension of the chord 34 does not pass exactly through the center of the valve stem 20. However, it will be equally apparent from FIG. 2 that a distance from the precise center of the valve stem 20 to the nearest extension of the chord 34, is indeed, less than 10% of the diameter of the cylinder bore 12. If these aforementioned parameters with respect to the concave surface are adhered to improved swirl is obtained within the cylindrical bore 12 without any reduction in flow and without any increase in fuel consumption.

Referring particularly to FIG. 1, it is seen that the concave surface 32 can form a continuous part of the inner duct wall 30. Thus, the improvements of the present invention can be realized without any vane being present at all within the passage 22.

Referring now to FIG. 2 there is illustrated an embodiment of the present invention wherein the section of the inner wall 30 adjacent the valve 14 comprises a vane 36 which extends from a first end 38 thereof adjacent the valve 14 to a second end 40 thereof spaced from the valve 14 and adjacent a continuation 42 of the inner wall 30. In such an embodiment, means are provided for pivotally mounting the second end 40 of the vane 36 within the passage 22. In the particular embodiment illustrated in FIG. 2 this means comprises a pin 44 which is keyed or splined to the vane 36. Means are also provided for rotating the vane 36 about the pivotal attachment thereof. In the particular embodiment illustrated, the rotating means comprises rack means 46 which causes the pin 44 to rotate and thereby cause the vane 36 to rotate. The rack means 46 which is of a conventional nature is used to rotate the vane 36 towards the outer wall 28 at low engine speeds and away from the outer wall 28 at higher engine speeds.

Means are provided for constraining the aforementioned rack means 46 to adjust the position of the vane 36 in order to optimize engine performance at all engine operating conditions. The constraining means for the present invention comprises conventional control means 48 which conventionally detect engine speed as by picking up an electrical signal from an engine governor (not shown) as represented at 50 and fuel consumption as by picking up a signal responsive to fuel pump rack position (not shown) as represented at 52 and then send a signal as represented by a line 56 to motivate the rack means 46 which in turn motivates the pin 44 and thus the vane 36. In practice, the rack means 46 can comprise a rack 100 which meshes with a pinion 102 which turns the pin 44. The rack 100 is motivated by a hydraulic cylinder 104. The expansion and construction of the cylinder 104 is controlled by the signal of line 56 which shifts shifts a valve 106 to deliver pressurized fluid from a pump 108 selectively via a line 110 to a rod end 112 or via a line 114 to a head end 116 of the cylinder 104.

In the particular embodiments illustrated in FIGS. 2–5 the inlet passage 22 includes a recess 58 from the continuation 42 of the inner passage wall 30 to a location adjacent the valve 14. Further, the second end 40 of the vane 36 is then positioned in the aforementioned recess 58. This provides smooth controlled flow from the continuation 42 of the inner wall 30 and along the concave surface 32 of the vane 36 to the area of the valve 14.

Figure 3:
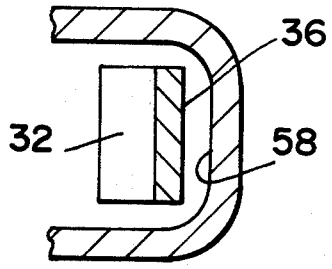
FIG. 3 illustrates a view taken along the line III—III of FIG. 2.

FIG. 3 illustrates in section the vane 36 of FIG. 2. It will be noted that in the embodiment of FIGS. 2 and 3 the concave surface 32 falls substantially on a surface of a cylinder which has an axis parallel to the axis 16 of the cylindrical bore 12.

First Alternate Embodiment

Figure 4:
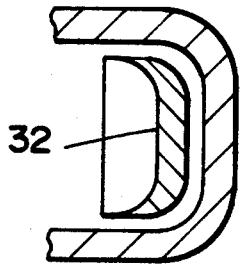
FIG. 4 illustrates a view similar to FIG. 3 but utilizing a different geometry for the vane.

The first alternate embodiment of the present invention corresponds to an embodiment as illustrated in FIGS. 2 and 3 wherein the vane 36 is provided with and is pivotally mounted at a pin 44 or the like to the passage 22. However, it has been found that when the vane 36 is pivotally mounted in the inlet passage 22 at a second end 40 thereof which is spaced from the valve 14 with a first end 38 of the vane 36 being adjacent the valve 14, that it has not been necessary for the surface 32 to fall substantially on the surface of a cylinder which has an axis parallel to the axis 16 of the cylindrical bore 12. As illustrated in the embodiment of FIG. 4 the surface of the vane 36 may curve inwardly at the top and bottom thereof.

Second Alternate Embodiment

Figure 5:
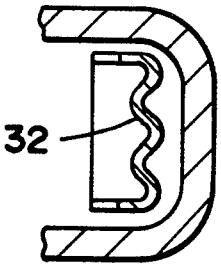
FIG. 5 illustrates a different embodiment than FIG. 3 utilizing yet another geometry for the vane.

Referring now to FIG. 5 it can be seen that the surface 32 of the vane 36 can also be longitudinally corrugated or may be any other desired shape which will provide fairly smooth flow therealong and which is generally concave toward the outer wall 28. In this regard it is noted that the embodiment of FIG. 5 the corrugations are generally parallel to the vane 36 and extend from the first end 38 thereof to the second end 40 thereof.

It has been found that in accordance with the present invention flow through the inlet passage 22 is not obstructed but is instead only readjusted in direction. It has further been found that such an inlet passage 22 can even improve flow by as much as 2% rated speeds and serves to reduce fuel consumption by as much as 3% thus indicating better mixing of fuel due to higher swirl. Also, some reduction in smoke has been noted utilizing an inlet passage in accordance with FIG. 1 of the present invention thus indicating better combustion due to the better swirl.

While the invention has been described in connection with specific embodiments thereof, it will be understood that it is capable of further modification, and this application is intended to cover any variations, uses or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

The embodiments of the invention in which an exclusive property or privilege is claimed are defined as follows:

1. In a cylinder assembly of an internal combustion engine which comprises a cylindrical bore, a generally circular valve communicating with an end of said cylindrical bore intermediate an axis and an outer bore wall thereof, said valve being adjacent and substantially tangent to said outer bore wall, said valve having a valve stem extending away from said end of said cylindrical bore and an inlet passage having a first portion extending away from said valve generally parallel to said valve stem and a second portion generally perpendicular to said first portion and extending away from said cylindrical bore, said inlet passage having an outer generally linearly extending wall generally tangent to said outer bore wall adjacent said valve and an inner wall opposite said outer wall, an improvement comprising:

a concave surface forming a section of said inner wall adjacent said valve and facing towards said outer wall, said concave surface falling substantially on a surface of a cylinder which has an axis parallel to that of the cylindrical bore, a radius of curvature of said concave surface falling within a range from about 65% to about 35% of a diameter of said cylindrical bore, said section comprising a vane extending from a first end thereof adjacent said valve to a second end thereof spaced from said valve and adjacent a continuation of said inner wall;

means for pivotally attaching said second end of said vane to said inner wall; and means for rotating said vane about said pivotal attaching means responsive to engine speed, said vane being rotated towards said outer wall at lower engine speeds and away from said outer wall at higher engine speeds.

2. An improvement as in claim 1, including:

means for constraining said rotating means to adjust said vane position of rotation to optimize engine performance at all engine operating conditions.

3. In a cylinder assembly of an internal combustion engine which comprises a cylindrical bore, a generally circular valve communicating with an end of said cylindrical bore intermediate an axis and an outer bore wall thereof, said valve being adjacent and substantially tangent to said outer bore wall, said valve having a valve stem extending away from said end of said cylindrical bore and an inlet passage having a first portion extending away from said valve generally parallel to said valve stem and a second portion generally perpendicular to said first portion and extending away from said cylindrical bore, said inlet passage having an outer bore wall adjacent said valve and an inner wall opposite said outer wall, an improvement comprising:

a recess in said inner wall starting adjacent to said valve and proceeding a distance away therefrom;

a vane extending from a first and thereof adjacent to said valve to a second end thereof spaced from said valve, adjacent to said inner wall and generally within said recess;

means for pivotally attaching said second end of said vane to said recess; and means for rotating said vane about said pivotal attaching means responsive to engine speed, said vane being rotated towards said outer wall at lower engine speeds and away from said outer wall at higher engine speeds.

4. An improvement as in claim 3, including:

means for constraining said rotating means to adjust said vane position of rotation to optimize engine performance at all engine operating conditions.

* * * * *